United States Patent [19]

de San

[11] 4,219,984

[45] Sep. 2, 1980

[54] METHOD OF MANUFACTURING BUILDING PANELS

[76] Inventor: Maurice G. de San, Rte. Gouvernementale, 174, 1950 Kraainem, Belgium

[21] Appl. No.: 965,210

[22] Filed: Nov. 30, 1978

[51] Int. Cl.[2] ..... E04C 1/00

[52] U.S. Cl. ..... 52/741; 52/315; 264/46.4; 264/46.5

[58] Field of Search ..... 52/309.12, 314, 315, 52/741; 264/46.4, 46.5, DIG. 82

[56] References Cited

U.S. PATENT DOCUMENTS

| | | | |
|---|---|---|---|
| 3,629,384 | 9/1969 | Eigenstierna | 264/46.5 X |
| 3,646,715 | 3/1972 | Pope | 52/315 X |
| 3,649,424 | 3/1972 | Rhiando | 52/315 X |
| 3,868,801 | 3/1975 | Weiner | 52/315 X |

FOREIGN PATENT DOCUMENTS

| | | | |
|---|---|---|---|
| 2803389 | 3/1978 | Fed. Rep. of Germany | 52/315 |

*Primary Examiner*—Price C. Faw, Jr.
*Assistant Examiner*—Carl D. Friedman
*Attorney, Agent, or Firm*—Sughrue, Rothwell, Mion, Zinn and Macpeak

[57] ABSTRACT

A method is described for manufacturing building panels comprising a core of rigid cellular material having spaced apart thin brick elements bonded to one face thereof. The described method permits to achieve premanufactured panels which, when assembled in adjacent relationship, have a pleasing undistinguishable appearance from a conventional masonry.

1 Claim, 4 Drawing Figures

METHOD OF MANUFACTURING BUILDING PANELS

BACKGROUND OF THE INVENTION

This invention relates to a method for manufacturing building panels and more particularly premanufactured building panels comprising a core of rigid foamed material, e.g. polyurethane, with brick elements bonded to one face thereof.

In the construction of premanufactured buildings an important object is to provide buildings having, when looked from the outside, an appearance similar to conventional non-premanufactured buildings. The "prefabricated" appearance generally implies cheap construction with poor insulation quality and short lifetime so that the prefabricated buildings still do not have a good record of suitability when quality is desired. Furthermore, the "prefabricated" appearance is hard tolerated in residential areas.

In an attempt to solve this problem, premanufactured building panels have been designed including bricklike facing elements which give an attractive appearance similar to a conventional non-prefabricated masonry. One such type of panel has been disclosed by Pope in U.S. Pat. No. 3,646,715. This panel comprises a rigid core of cellular polymeric material, spaced facing elements bonded to one face of this core, and granular material adhered to and embedded in the cellular material between the facing elements to provide an exterior mortarlike appearance. The use of such a panel provides a building with walls having virtually the exterior appearance of a normal brick and mortar wall except the joints between the panels which inevitably reveal the prefabrication technique.

One method to overcome this problem would be to manufacture great size walls in one piece preformed with the required openings for the windows and doors. Such a method is expensive and has the drawback of rendering the transportation and the positioning of these walls difficult and requiring mechanical engines for the handling thereof.

According to the more feasible method disclosed by Pope, the panels are preformed with the side edges thereof adapted to mate with the surface of an edge of other panels positioned in adjacent relationship. Each panel, along its side edges, has projecting facing elements which extend in alternate rows beyond the facing elements in adjacent rows a distance equal to one-half their length. When two panels are positioned in adjacent relationship, a joint is formed comprising a vertical succession of mating ridges and grooves. A suitable precision however is hard to obtain at the joint as the facing elements, made of baked clay, have irregular edges and consequently a small gap (some millimeters or so) should always be provided in practice. This method has three major drawbacks. First, the projecting half facing elements along the edges of the panels are fragile and there is a great possibility of breaking them during the handling of large or heavy panels. Also, the manufacturing of such panels is difficult to realize with a suitable precision.

Second, anyway there still remains the problem of rendering invisible the crenelled small gap which occurs between adjacent panels. In effect, the mortarlike joint between facing elements in the panel is obtained by impregnation of the injected plastic material, as it is being foamed, into the granular material between the facing elements in the mold. Such a joint has a particular appearance which is hard to imitate in the gap between adjacent panels by simply mixing plastic material and sand on the site. Furthermore, it is practically impossible to fill the said gap evenly without burrs being formed all along, such that a distinguishable appearance still occurs along the joints.

Third, the impregnation depth of the cellular material into the sand varies depending on how fastly the injected liquid cellular material reaches the different points along the joints between facing elements. Where the cellular material reaches the joint when still in the form of liquid, there occurs a deep impregnation of sand but where the cellular material reaches the joint only as it is being foamed, the impregnation is less deep. For instance, with a joint made of polyurethane-impregnated sand with a mean impregnation depth of 5 mm, the impregnation depth varies actually between 8 and 3 mm. This depth variation is not too much apparent across the panels as this variation is progressive. However, along the joint between adjacent panels, the said variation makes a step which can be as high as 5 mm, thereby requiring the joint to be entirely remade and this results in a distinguishable appearance between the premanufactured joints and the new joint made on site. This distinguishable appearance, though not readily apparent from nearby, is really readily apparent from a distance for this new joint extends on one briquette length and along all the height of a panel, and this new joint occurs repeatedly at regular intervals, e.g. 1.2 m.

One solution to solve the problem of avoiding distinguishable joints between adjacent panels would be to cover the joints between facing elements with a layer of cement mortar and to use the same mortar for jointing the adjacent panels. However, unless using facing elements having a greater thickness, that is more expensive and heavier panels, the available depth at the joints between the facing elements generally is not enough to obtain durable joints. Usually, the facing elements are approximately 12 mm thick so that an impregnated joint having a depth of 5 to 8 mm only leaves an available depth of 7 to 4 mm. When the purpose is to realize sunk joints between facing elements, the available depth for the exterior mortar joint is only 5 to 2 mm approximately which is obviously insufficient for providing a good durable joint.

SUMMARY OF THE INVENTION

An object of the invention is to provide a method of manufacturing wall panels which, when being assembled in adjacent relationship, allow the joints therebetween to have an undistinguishable appearance from the joints between the facing elements.

Another object of the invention is to provide a premanufactured panel which permits walls to be assembled having the conventional exterior appearance of mortar and brick masonry.

In accordance with this invention, a premanufactured wall panel comprising a core of rigid cellular material having spaced apart thin brick elements bonded to one face thereof, is realized by first placing the brick elements, face down, in the desired relation on the bottom of a mold, and then filling the gaps between the brick elements with a mixture of a finely powdered material and a catalyst or accelerator for the foaming reaction of the plastic material which will form the rigid cellular core. The latter is then formed by injecting the said plastic material to be foamed into the mold over the back of the brick elements and the layer of said mixture between the brick elements, and permitting the foaming reaction to be completed with a backing plate on the back face of the core. Thereafter, the panel is demolded and placed on its backing plate, brick elements up, and then the gaps between the brick elements cleared from the said mixture are filled with a cement mortar.

Obviously, in a variation the backing plate can be secured or bonded to the back face of the core after the panel having been demolded.

The premanufactured panel according to the invention comprises a core of rigid cellular material, spaced apart thin brick elements bonded to one face of said core, a backing plate on the opposite face of said core, and cement mortar joints between the thin brick elements.

DESCRIPTION OF THE INVENTION

Figure 1:
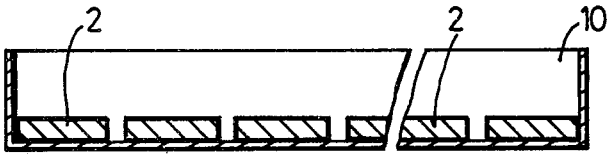
FIGS. 1 to 4 are schematic drawings illustrating the steps of the method according to the invention.
Figure 2:
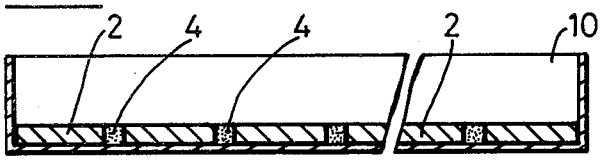

The premanufactured panel to be realized consists of a core 1 of rigid cellular material, e.g. polyurethane foam, having spaced apart thin brick elements 2 bonded to one face thereof and preferably a backing plate 3 on the opposite face thereof. The problem which the invention is concerned with, is to provide between the spaced apart brick elements 2 suitable joints having an exterior appearance which will not be distinguishable from the joints which will be made between adjacent panels on the building site. The building panel is manufactured in accordance with this invention utilizing the following method, the steps of which are illustrated in FIGS. 1 to 4. The thin brick elements 2 are placed, face down, in the desired fashion on the bottom of a suitable mold 10 (FIG. 1). The gaps between the brick elements 2 are then filled with a mixture 4 of a finely powdered material and a suitable catalyst or accelerator for the foaming reaction of the plastic material to be used for forming the rigid cellular core (FIG. 2).

The finely powdered material can be sand of very fine mesh, portland cement or some other material suitable for filling the gaps between the brick elements 2 such that the plastic material injected in the form of liquid for being foamed will not flow under the brick elements.

The catalyst or accelerator can be comprised of any tertiary amines, e.g. tri-ethylene diamine N-methyl morpholine, or organo-metallic compounds, e.g. stannous octoate or dibutyl tin dilaurate. The percentage of catalyst or accelerator may be as high as 10 to 50% of the powdered material.

Figure 3:
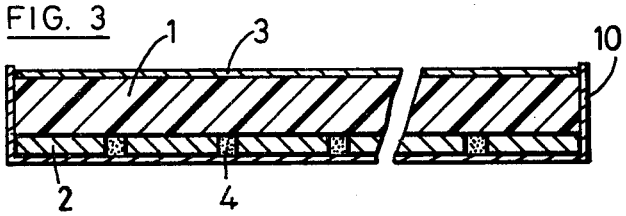

The mold is then covered with the rigid backing plate 3 and the plastic material which will form the core 1 is injected into the space between the brick elements with the said mixture 4 therebetween and the backing plate 3 (FIG. 3). Due to the presence of the powdered catalytic material in the gaps between the brick elements 2, the plastic material, e.g. polyurethane, is caused to polymerize and jellify immediately as soon as it comes in contact with the mixture 4, thereby preventing the penetration of plastic material into the powdered material.

Figure 4:
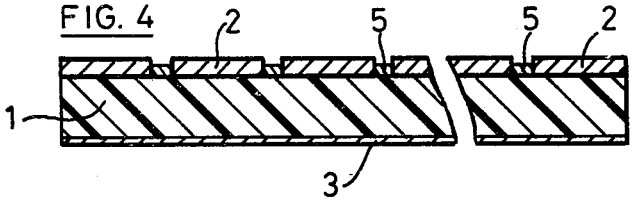

The plastic material is permitted to complete the foaming reaction and to form a rigid core. The completed panel may then be removed from the mold and the powdered material then clears the gaps between the brick elements 2, leaving these gaps completely void. The panel is thereafter laid on the backing plate 3, brick elements up, and the gaps between the brick elements 2 are filled with cement mortar 5 (FIG. 4). The same mortar will be used for the joints between the adjacent panels on the building site. The panels normally are manufactured with staggered horizontal rows of brick elements 2 just like in a conventional masonry. The half-brick positions in the alternate rows of brick elements along the side edges of the panels are then left void, thereby forming recesses. When the panels are placed in adjacent relationship, these recesses become paired in registry and provide pockets for the subsequent insertion of brick elements 2 to be bonded with yet the same mortar. The joints between the brick elements 2 and the joints between the panels will then have the same exterior appearance and consequently the walls assembled when using panels according to the invention will have the same uniform and pleasing exterior appearance as a conventional non-prefabricated masonry.

Another advantage ot the premanufactured panel of the invention is that the presence of mortar joints between the brick elements avoids any possibility of combustion or flame transmission by contrast with the joints made of sand impregnated by plastic material.

What is claimed is:

1. A method of manufacturing wall panels comprising a core of rigid cellular material having spaced apart thin brick elements bonded to one face thereof and a backing plate on the opposite face thereof, the method comprising the steps of:

placing the brick elements, face down, in the desired relation on the bottom of a mold;

filling the gaps between the brick elements with a mixture of a finely powdered material and a catalyst or accelerator for the foaming reaction of the plastic material which will form the rigid cellular core;

forming said rigid core by injecting the said plastic material to be foamed into the mold over the back of the brick elements and the layer of said mixture between the brick elements, and permitting the foaming reaction to be completed with the backing plate on the back face of the core;

demolding the panel and placing it on the backing plate, brick elements up; and filling the gaps between the brick elements, cleared from the said mixture, with a cement mortar.

* * * * *